US005144903A

United States Patent [19]

Ozeki

[11] Patent Number: 5,144,903

[45] Date of Patent: Sep. 8, 1992

[54] YACHT AND YACHT MODEL

[76] Inventor: Jiro Ozeki, 15, Senkawa-cho 2-chome, Toshima-ku, Tokyo, Japan

[21] Appl. No.: 434,065

[22] Filed: Nov. 9, 1989

[30] Foreign Application Priority Data

Nov. 2, 1988 [JP] Japan ..... 63-278349
Sep. 26, 1989 [JP] Japan ..... 1-249729

[51] Int. Cl.[5] ..... B63H 9/04
[52] U.S. Cl. ..... 114/103; 114/39.001
[58] Field of Search ..... 446/153, 160, 163; 114/39.1, 102, 103, 89, 97, 109, 111

[56] References Cited

U.S. PATENT DOCUMENTS

| | | | |
|---|---|---|---|
| 1,792,106 | 2/1931 | Luders | 114/103 |
| 2,106,209 | 1/1938 | Edge | 114/39.1 |
| 2,680,921 | 6/1954 | Gowland | 446/160 |
| 4,503,796 | 3/1985 | Bierig | 114/103 |
| 4,704,979 | 11/1987 | Ammen et al. | 114/102 X |

*Primary Examiner*—Edwin L. Swinehart
*Attorney, Agent, or Firm*—Michael O. Warnecke

[57] ABSTRACT

A yacht model or a full scale yacht includes a hull and a mast is provided on the hull to extend upward from the hull to support a main sail. A spinnaker is provided in front of the mast and the spinnaker is made of a plastic material and formed in a bulged configuration to possess an appearance of receiving wind. The spinnaker has a top portion connected to an upper portion of the mast in a manner which allows a turning movement of the spinnaker about the mast. Booms may be provided between the mast and a lower portion of the spinnaker for maintaining the lower portion of the spinnaker in a position spaced from the mast while allowing the turning movement. The lower portion of the spinnaker is connected at the opposite sides to a rear portion of the hull through strap like flexible connecting members.

13 Claims, 8 Drawing Sheets

YACHT AND YACHT MODEL

BACKGROUND OF THE INVENTION

1. Field of the Invention

The present invention relates to yacht having a spinnaker provided in front of a main sail. The present invention can be embodied both as an actual yacht suitable for sailing with crews on board or as a model of a yacht which may be of a reduced scale. More particularly, the present invention relates to a yacht structure which is suitable not only for display but also for sailing on water when it is embodied as a model of a reduced scale.

2. Description of the Prior Art

Conventionally, a yacht model includes a hull provided with a main sail and a jib. Recently, there are many yachts which are provided with a spinnaker provided in front of the main sail for receiving back wind to produce forward thrust force. In those yachts, the spinnakers are made of flexible cloths or sheets so that they cannot retain their bulged shapes when they are not receiving back wind. When it is intended to build a model of a yacht having a spinnaker, it becomes difficult to represent or express the bulged shape of the spinnaker if it is made of a flexible cloth or a sheet, so that such model will not have an appearance of an actual yacht having a spinnaker. The spinnaker for a yacht model may therefore be formed by a plastic material through a suitable forming technique so that the spinnaker possesses a bulged shape. It should however be noted that a yacht model having such a spinnaker may not be suitable for enjoying by operating on water using the spinnaker as effective thrusting means because the spinnaker will not be able to change freely its orientation depending on the direction of wind to which it is exposed.

It should further be noted that a spinnaker of conventional yacht is designed so that it receives wind coming from backside or obliquely backside to produce a thrust force. Therefore, the spinnaker must be folded down and the jib must be used instead when the wind comes front.

SUMMARY OF THE INVENTION

It is therefore an object of the present invention to provide a yacht or a yacht model which has a spinnaker of a bulged configuration to have an appearance of receiving wind but nevertheless can satisfactorily function to produce thrust on water by receiving wind.

Another object of the present invention is to provide a yacht or a yacht model having a spinnaker which can be used even under wind coming front.

According to the present invention, the above and other objects can be accomplished by providing yacht having a spinnaker of a bulged configuration to possess an appearance of receiving wind, the spinnaker being carried at the top portion by a mast and connected at the opposite sides of the lower portion to the rear portion of the hull in a manner that it can turn around the mast with a spacing between the mast and the spinnaker. The spinnaker may be made by a hard or semi-hard plastic material through an appropriate forming technique. Alternatively, the spinnaker may be made of a cloth or a flexible sheet, the configuration of the spinnaker being retained by means of appropriately shaped rib members which may be attached to the cloth or the sheet forming the spinnaker. Preferably, the opposite sides of the lower portion of the spinnaker are interconnected to the mast through relatively rigid booms in a manner that a turning movement of the spinnaker is allowed and the spinnaker or the booms are connected to the rear portion of the hull through strap members or the like.

According to another mode of the present invention, support arms may be provided to assist the booms in the case where it is difficult to support the lower portion of the spinnaker only by the booms. When the present invention is embodied in a yacht model, the opposite sides of the lower portion of the spinnaker may be connected to the rear portion of the hull through wire or strap like members which may be secured to pins or like members provided on the hull.

According to the features of the present invention, the spinnaker can change its orientation depending on the wind impinging upon the spinnaker to produce the thrust. It should therefore be understood that the spinnaker is not limited to the use with back wind. Since the spinnaker is retained in the bulged shape to present an appearance of receiving wind, a yacht model embodying the present invention has an appearance that the spinnaker is bulged under wind so that it is suitable for display. The spinnaker is carried at the top end portion by the upper portion of the mast and connected at the lower portion to the hull or to the mast, so that the spinnaker is maintained in a position where it should be during sailing under wind.

It should further be noted that the yacht in accordance with the present invention can produce a forward thrust even under a head wind. When wind comes obliquely front and flows along the spinnaker, there will be produced an aerofoil effect due to the curved configuration of the spinnaker generating an aeronautical force which will have a forwardly directed component. Since it is possible to provide the spinnaker with a deeply bulged configuration, the aforementioned aeronautical force can be of a value that the forward component of the force can contribute to sailing under a wind force.

According to the present invention, it is also possible to connect the opposite sides of the lower portion of the spinnaker through a strap of an adjustable length. With this arrangement, when the hull is sidewardly inclined under a side wind, the spinnaker will be swung under a gravitational force toward the direction of wind and maintained at an angle with respect to the direction of wind to function as a jib. Thus, it will be understood that the spinnaker of the present invention can change its orientation in accordance with the direction of wind to generate a force effectively utilizing the wind force.

The above and other objects of the present invention will become apparent from the following description of preferred embodiments taking reference to the accompanying drawings.

DESCRIPTION OF THE PREFERRED EMBODIMENT

Figure 1:
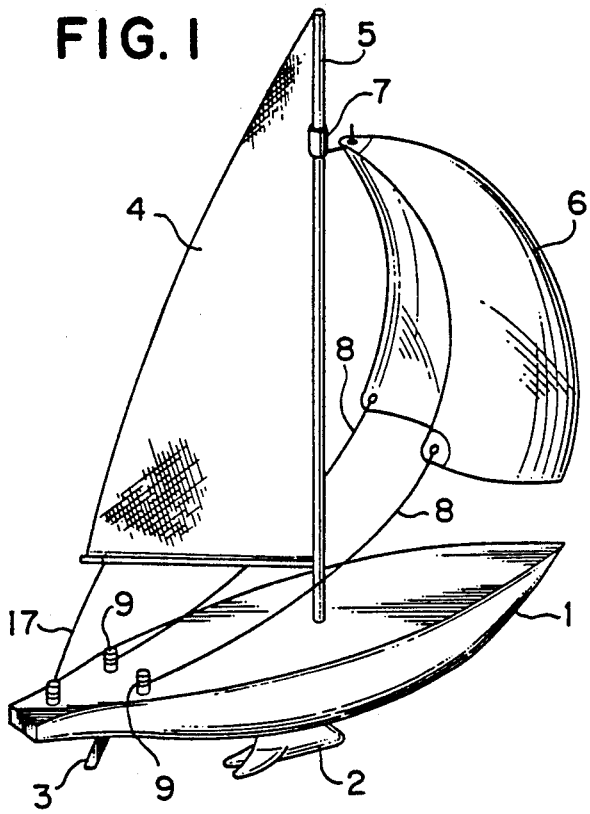
FIG. 1 is a perspective view of a yacht model in accordance with one embodiment of the present invention.

Referring now to the drawings, particularly to FIG. 1, there is shown a yacht model including a yacht hull 1 provided with a keel at the bottom side and a rudder at the rear end portion. The hull 1 is further provided with a mast 5 which extends upwards from the hull 1. As in a conventional structure, the mast 5 carries a main sail 4 which may be made of a flexible sheet such as a cloth.

A spinnaker 6 is provided in front of the mast 5. The spinnaker 6 is made of a hard or semi-hard plastic material and formed in a bulged configuration to present an appearance of receiving wind. The spinnaker 6 is substantially of an equilateral triangular shape having a top attached to the mast by means of a fitting 7. The lower portion of the spinnaker 6 is further connected at the opposite sides to a rear portion of the yacht hull 1 through connecting members 8 which may be made of wires. For the purpose, the hull 1 is provided with pins 9 at the opposite sides of the rear portion of the hull 1 and the wire members 8 connecting the spinnaker 6 to the yacht hull 1 are attached to the pins 9. It is preferable that the connecting wire members 8 are attached to the pins 9 so that a swingable movements of the members 8 are allowed. The main sail 4 ia also connected at the lower portion to the rear portion of the hull 1 through a suitable connecting member 17.

Apparently, the yacht model shown in FIG. 1 can be displayed by placing it on an appropriate stand. When the yacht model is displayed, the connecting wire members 8 function to support the lower portion of the spinnaker 6 to prevent it from being hung down along the mast 5. Thus, the spinnaker 6 can possess the appearance of receiving wind from rear side of the hull 1. When the yacht model is operated on water, the spinnaker 6 can swing around the mast 5 in accordance with the direction of the wind and produce thrust force. In this instance, the connecting members 8 can deflect whenever necessary so that they do not constrain the movement of the spinnaker 6. Thus, sailing under wind force is possible with this yacht model.

Figure 2A:
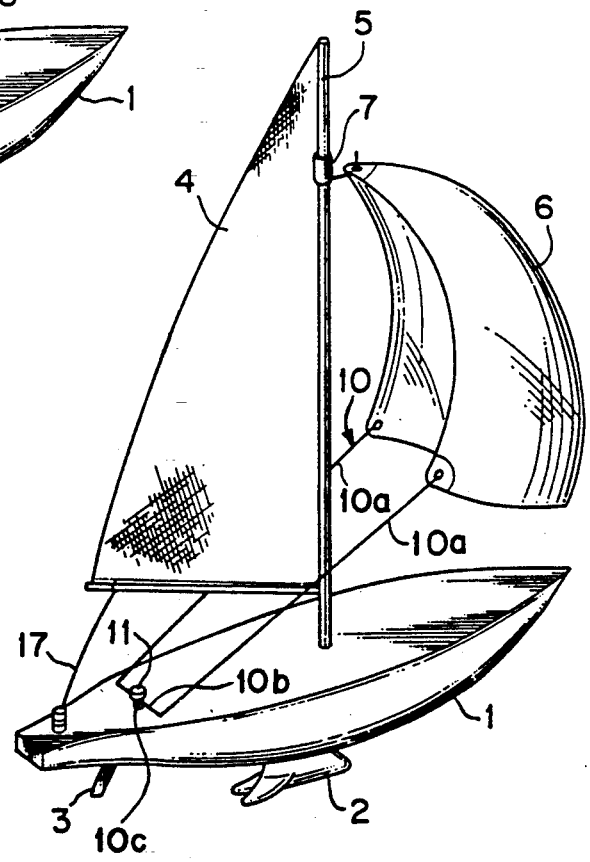
FIG. 2A is a perspective view showing a yacht model in accordance with another embodiment of the present invention.
Figure 2B:
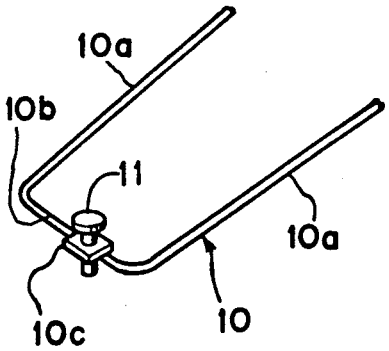
FIG. 2B is a perspective view showing a portion of a retention member used in the embodiment shown in FIG. 2A.

Referring now to FIG. 2A, the embodiment shown therein is different from the embodiment shown in FIG. 1 in that it includes a connecting member 10 made of a wire and having two longitudinal legs 10*a* which are connected together at one ends by a transverse arm 10*b*. The yacht hull 1 is provided with a pin 11 and the connecting member 10 is connected to the pin 11 at the center of the transverse arm 10*b* through a swivel joint 10*c* as shown in FIG. 2B. The function of the structure shown in FIG. 2A is the same as that of the structure shown in FIG. 1.

Figure 3A:
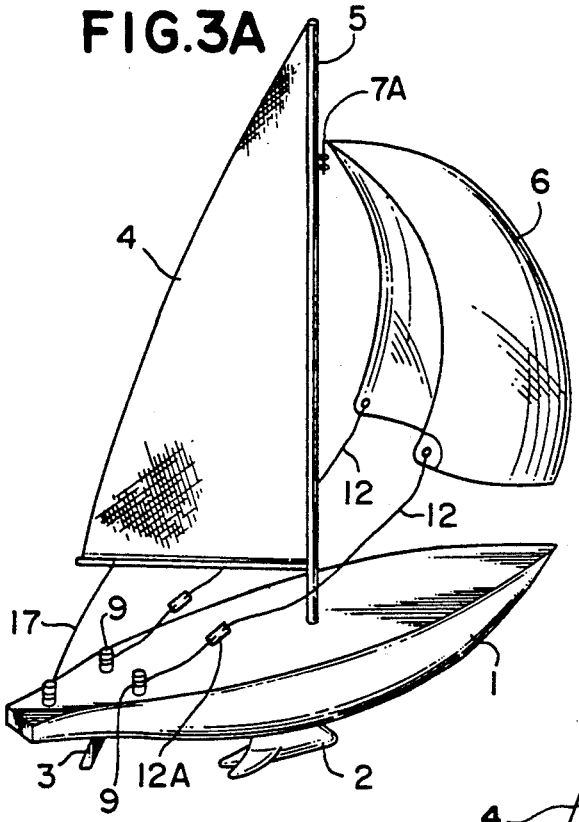
FIG. 3A is a perspective view of a yacht model in accordance with a further embodiment of the present invention.
Figure 3B:
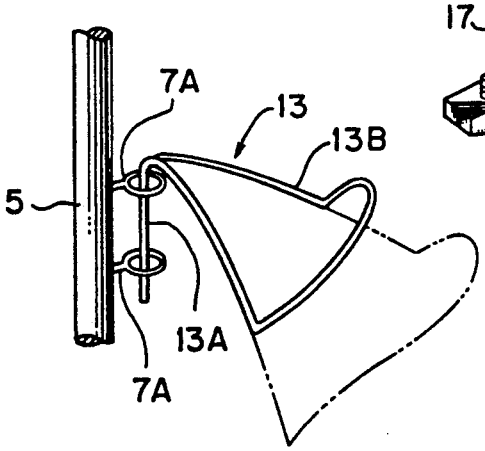
FIG. 3B is a perspective view of a fitting for attaching the spinnaker in the embodiment shown in FIG. 3A.

Referring to FIG. 3A, the yacht model shown therein has a spinnaker 6 which is attached to the upper portion of the mast 5 through a swivel joint structure which is shown in FIG. 3B. As shown, the mast 5 is provided with a pair of eye fittings 7A which are attached to the mast 5 one above the other. The spinnaker 6 is provided with a fitting 13 including a hook portion 13A and a triangular attaching portion 13B. The fitting 13 is attached to the spinnaker 6 at the attaching portion 13B and engaged with the eye fitting 7A at the hook portion 13A. The engagement between the eye fitting 7A and the hook portion 13B of the fitting 13 ensures that the spinnaker 6 is retained in the position with respect to the mast as shown in FIG. 3A while swivel movements of the spinnaker 6 is permitted. The lower portion of the spinnaker 6 is connected at the opposite sides to the hull 1 through connecting straps 12 which are engaged with pins 9 provided on the hull 1. The connecting straps 12 are respectively provided with adjusting device 12A for adjusting the length of the straps 12. When the yacht model is to be displayed, the connecting straps 12 are tightened through an adjustment of the device 12A so that the spinnaker 6 is constrained against swivel movements. When the yacht model is to be operated on water, the connecting straps 12 are slackened so that the spinnaker 6 is free to turn around the mast 5.

Figure 4:
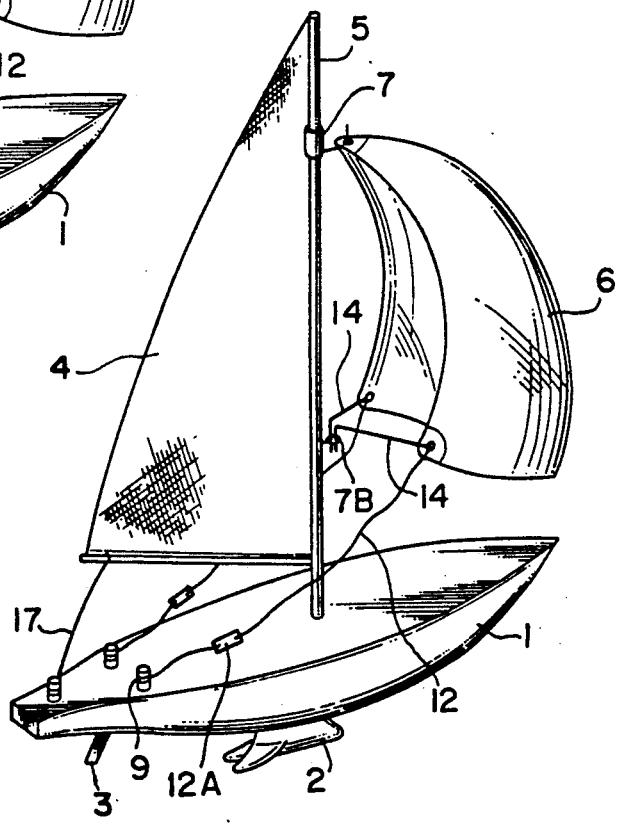
FIG. 4 is a perspective view of a yacht model in accordance with a further embodiment of the present invention.

Referring now to FIG. 4, the yacht model shown therein has a pair of booms 14 which are connected at one ends to the opposite sides of the lower portion of the spinnaker 6. The other ends of the booms 14 are engaged with eye fitting 7B provided on the mast 5 so that swivel movements of the booms 14 are allowed about the eye fittings 7B. The lower portion of the spinnaker 6 is further connected at the opposite sides to the yacht hull 1 through a pair of connecting straps 12 having a length adjusting device 12A as in the embodiment of FIG. 3A.

Figure 5:
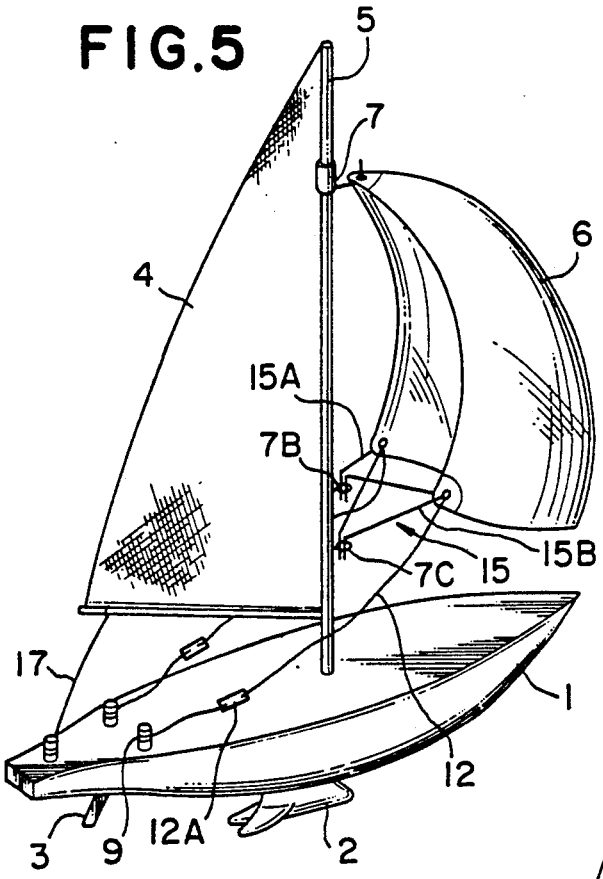
FIG. 5 is a perspective view of a yacht model showing still further embodiment of the present invention.

In FIG. 5, the yacht model shown therein includes a further pair of booms 15 which are connected at one ends to the opposite sides of the lower portion of the spinnaker 6. The other ends of the booms 15 are engaged with an eye fitting 7C which are provided on the mast beneath the eye fitting 7B. In other respects, the structure is the same as that in the embodiment of FIG. 4.

Figure 6A:
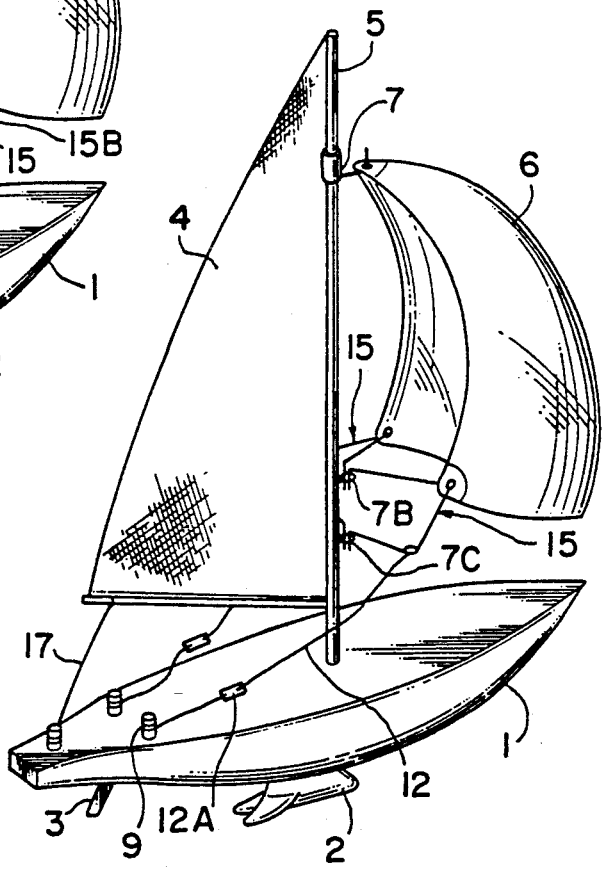
FIG. 6A is a perspective view of a yacht model showing a modification of the structure shown in FIG. 5.
Figure 6B:
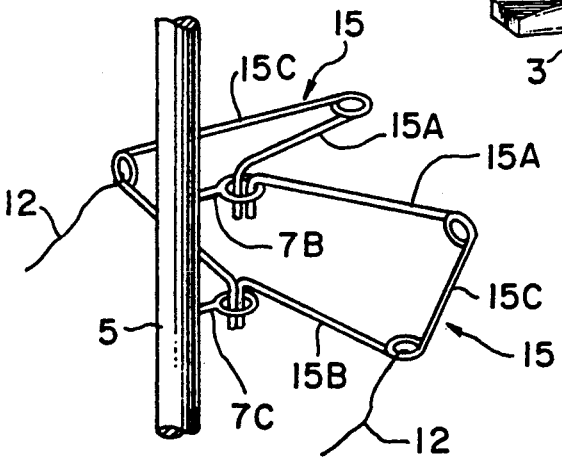
FIG. 6B is a perspective view showing the structure for attaching the boom in the structure shown in FIG. 6A.

Referring to FIG. 6A, there is shown a modification of the structure shown in FIG. 5. In the structure of FIG. 6A, the upper and lower booms are formed by a single wire member. As shown in FIG. 6B, the boom 15 includes an upper arm 15A which is engaged at one end with the upper eye fitting 7B. The upper arm 15A is contiguous with an eye portion formed at the front end portion of the upper arm 15A and the upper arm 15A is connected with the spinnaker 6 at the eye portion. The boom 15 further includes a lower arm 15B which has one end engaged with the lower eye fitting 7C. The lower arm 15B extends obliquely forward and is contiguous through a second eye portion with a connecting arm 15C which has a front end contiguous with the first mentioned eye portion. The second eye portion of the boom 15 is connected through a strap 12 with the pin 9 provided on the hull 1.

Figure 7A:
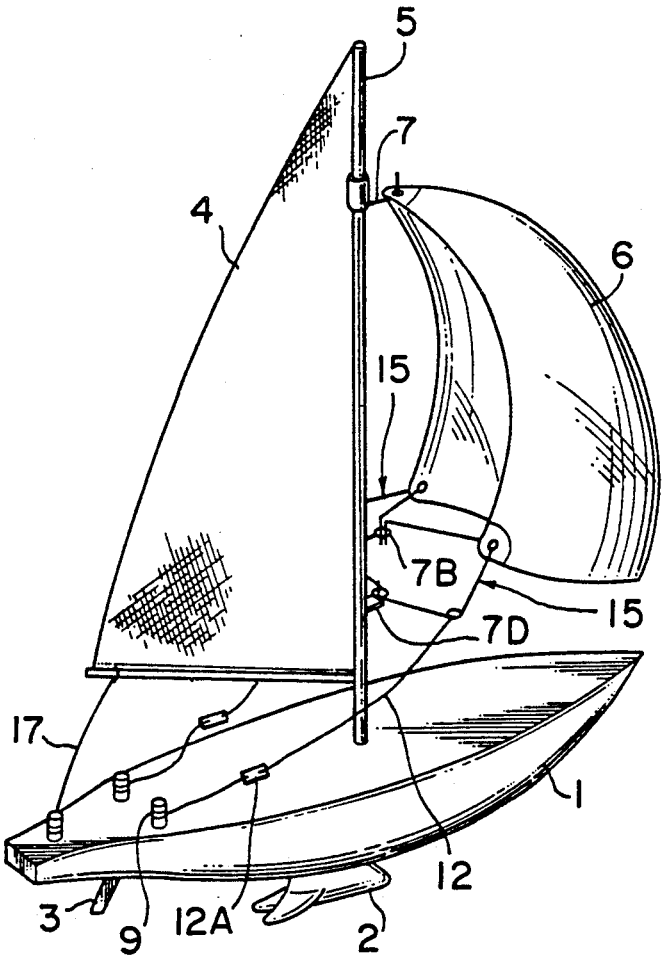
FIG. 7A is a perspective view of a yacht model showing a modification of the structure shown in FIG. 6A.
Figure 7B:
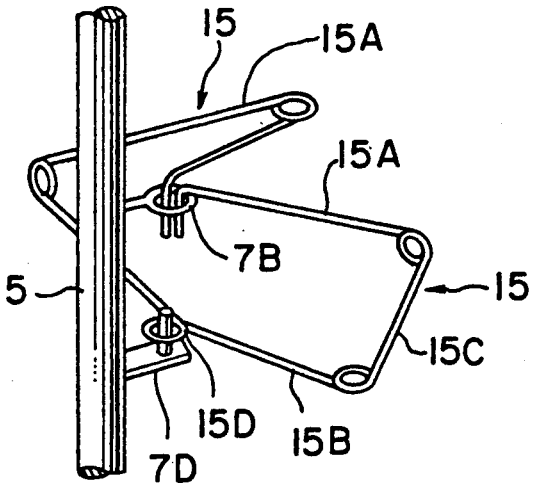
FIG. 7B is a perspective view showing the attachment of the boom in the structure shown in FIG. 7A.

FIGS. 7A and 7B show a modification of the boom structure shown in FIG. 6B. In this structure, a pair of booms 15 are made integrally from a single wire member. The left and right booms 15 are connected at the ends of the lower arms 15B by means of a third eye portion 15D. Instead of the lower eye fitting 7C in the embodiment of FIG. 6A, there is provided a pin bracket 7D on the mast 5 and the third eye portion 15D in the boom structure is engaged with the pin on the bracket 7D.

Figure 8A:
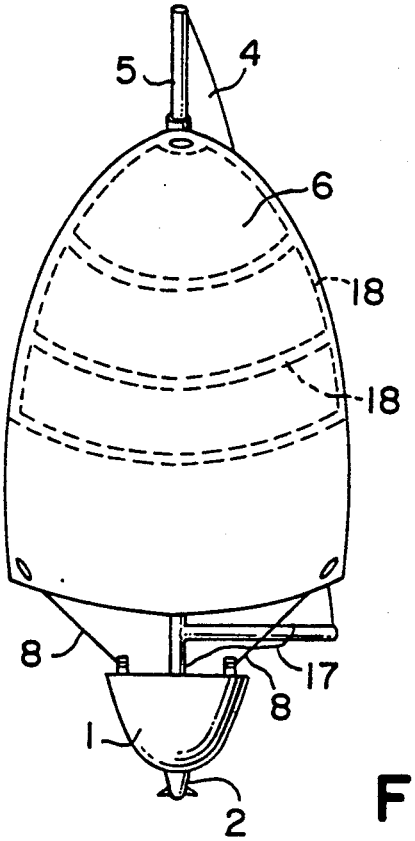
FIG. 8A is a front view showing a further embodiment of the spinnaker.
Figure 8B:
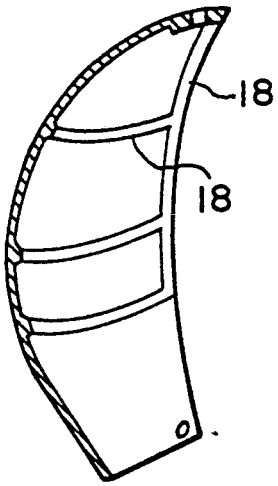
FIG. 8B is a sectional view of the spinnaker shown in FIG. 8A.

FIGS. 8A and 8B show another embodiment of the spinnaker 6. In this embodiment, the spinnaker 6 is formed at the rear surface with a plurality of laterally and longitudinally extending ribs 18. In other respects, the structure is the same as that in FIG. 1.

Figure 9:
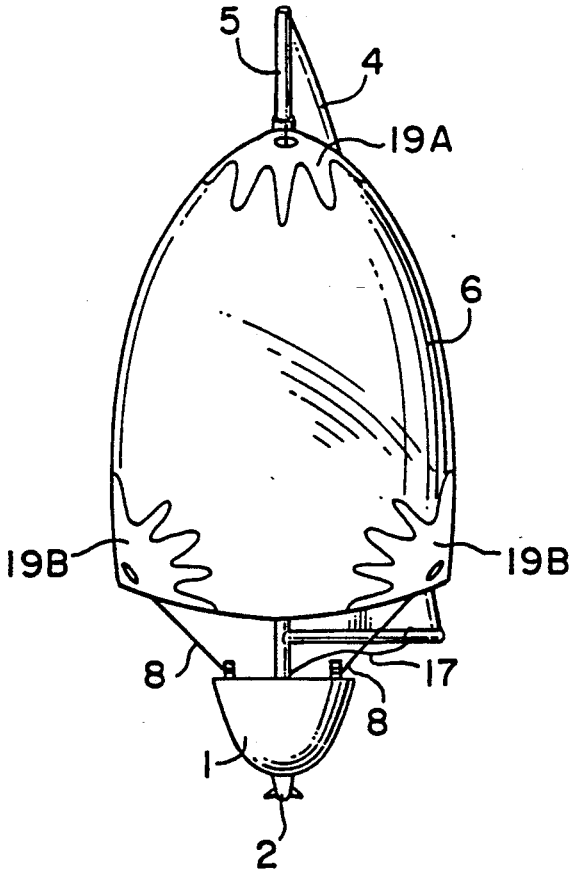
FIG. 9 is a front view showing a further embodiment of the spinnaker.
Figure 10:
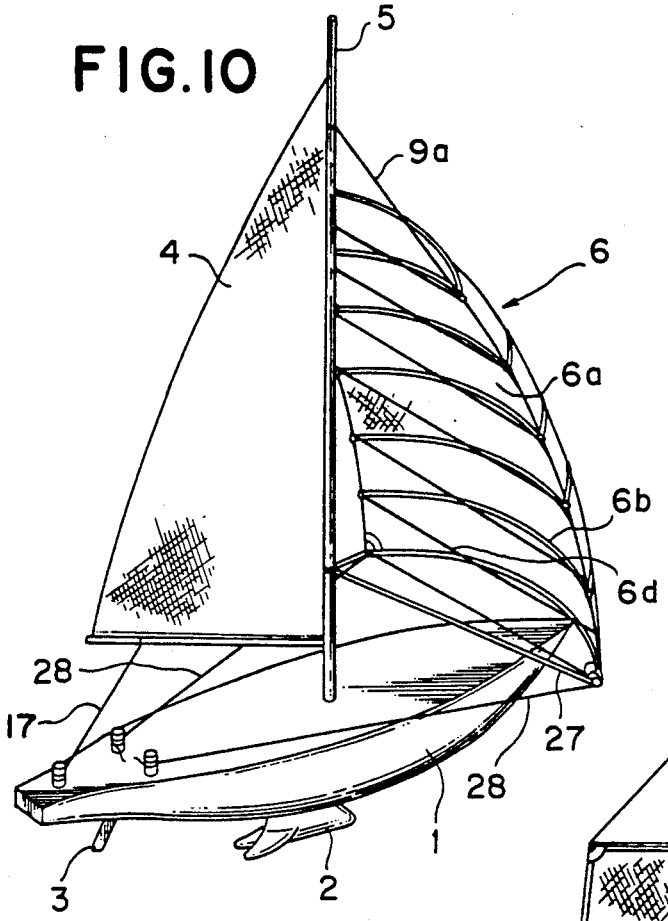
FIG. 10 is a perspective view of an actual yacht embodying the features of the present invention.
Figure 11:
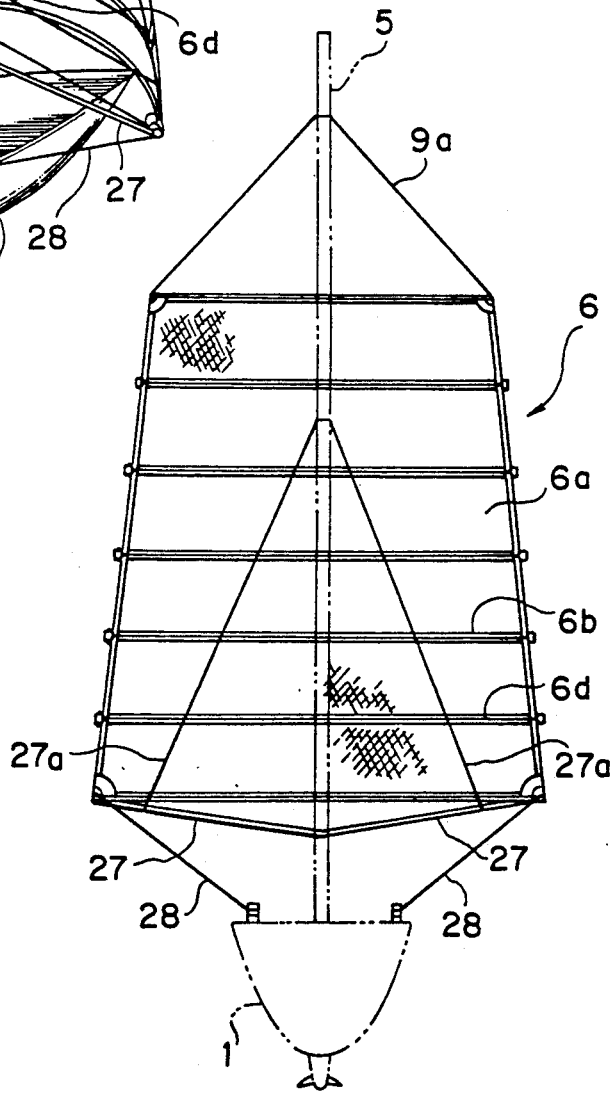
FIG. 11 is a front view of the yacht shown in FIG. 10.

Referring to FIG. 9, there is shown a further embodiment of the present invention. In this embodiment, the spinnaker 6 is provided at each corner portion with a reinforcement plate 19A, 19B attached thereto. The reinforcement plates 19A and 19B serve to prevent the spinnaker 6 from being broken in service at the connections with the connecting members.

Figure 12:
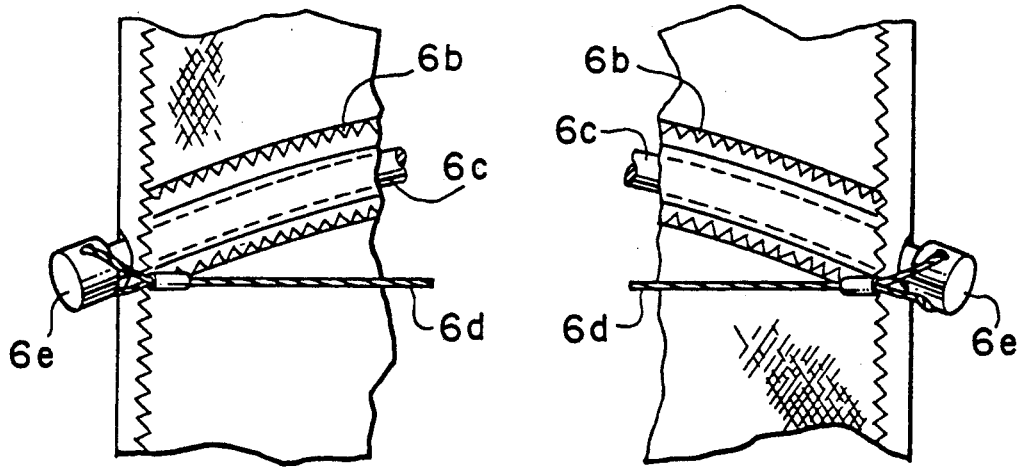
FIG. 12 is a front view in an enlarged scale showing the attachment of rib members to the spinnaker.

FIGS. 10 through 13 show an embodiment in which the present invention is embodied in a full scale yacht. In this embodiment, the spinnaker 6 is made of a flexible cloth or any other suitable sheet material. The spinnaker 6 has a wind receiving section 6*a* of substantially trapezoidal configuration and provided with a plurality of laterally extending arch-shaped ribs 6*c*. As shown in detail in FIG. 12, the wind receiving section 6*a* of the spinnaker 6 is formed at portions where the ribs 6*c* are to be installed with laterally extending pockets 6*b* and the rib 6*c* is inserted into each of the pockets 6*b*. In order to retain the rib 6*c* in the arch configuration, there is provided a connecting wire member 6*d* extending chordwise between the opposite ends of the rib 6*c*. As shown in FIG. 12, the wire member 6*d* is provided at the opposite ends with caps 6*e* which are fitted to the opposite ends of the rib 6*c*. It will therefore be understood that the spinnaker 6 is retained in a bulged configuration to possess an appearance of receiving wind.

Figure 13:
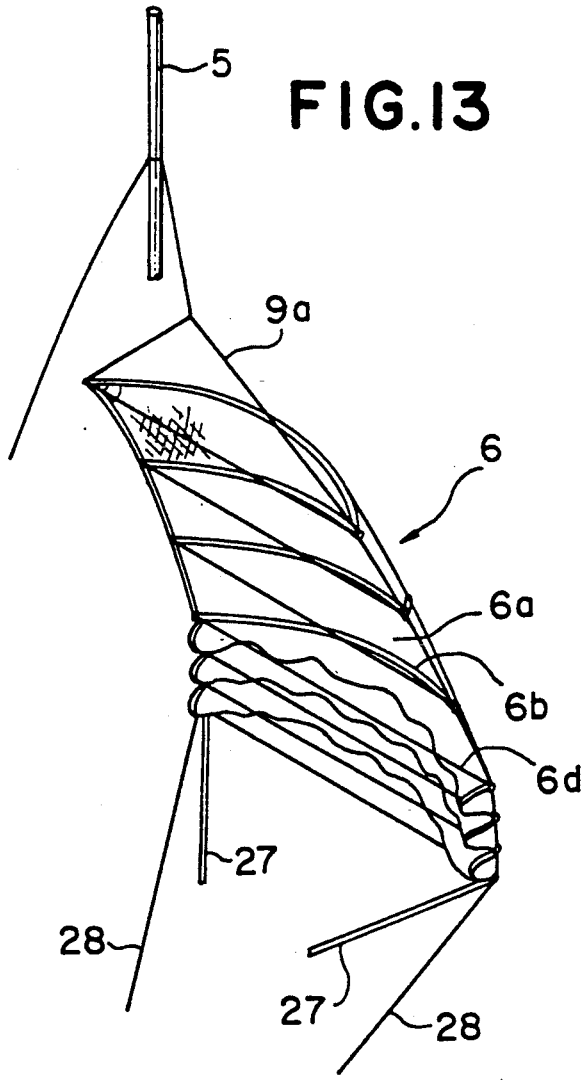
FIG. 13 is a perspective view showing the spinnaker in a folded state.

The upper end of the spinnaker 6 is connected to the mast 5 through connecting wires 9*a*. The lower portion of the spinnaker 6 is connected at the opposite sides to the mast 5 by means of a pair of booms 27 which have one ends connected to the mast for swivel movements. The lower portion of the spinnaker 6 is further connected at the opposite sides to the rear portion of the yacht hull 1 by means of connecting wires 28. An adjustment of the lengths of the wires 28 produces a turning or swivel movement of the spinnaker 6 about the mast 5 and the spinnaker 6 can be retained in the adjusted position. The spinnaker 6 of this embodiment can be folded down by slackening the wires 9*a* as shown in FIG. 13 when it is not needed. In other respects, the structure is similar to that in FIG. 1.

Figure 14:
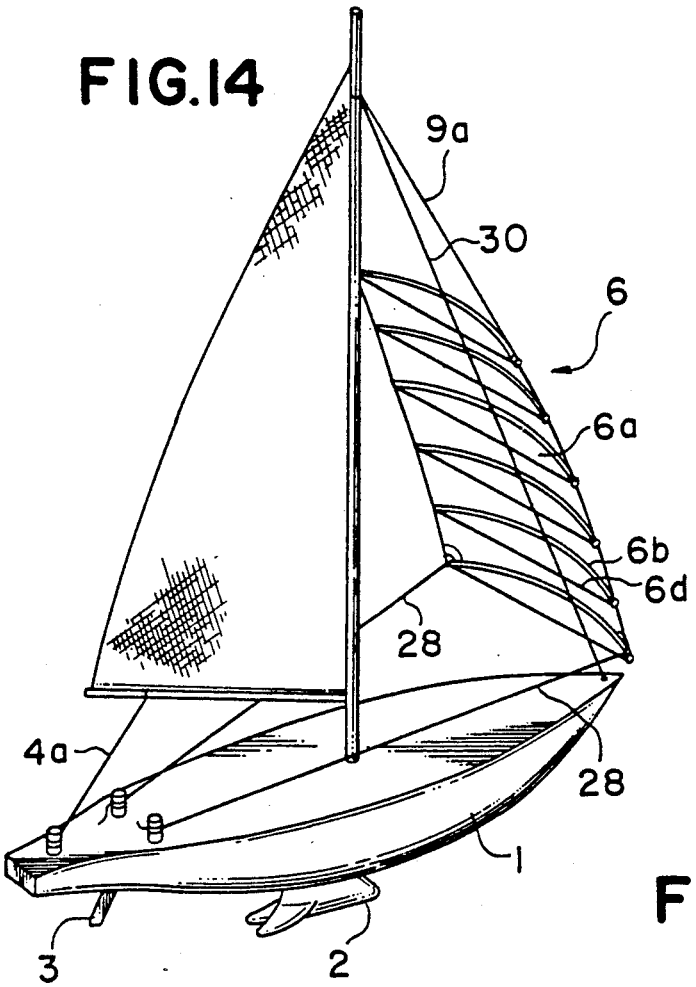
FIG. 14 is a perspective view showing a yacht in accordance with a further embodiment of the present invention.

Referring to FIG. 14, there is shown a further embodiment wherein the present invention is embodied in a full scale yacht. The structure of the spinnaker 6 is the same as that shown in FIGS. 10 through 13. In the embodiment of FIG. 14, a cable 30 is stretched between an upper end portion of the mast 5 and the front end portion of the hull 1. The cable 30 is connected to the spinnaker 6 at the center of each of the pockets 6*b* to which the ribs 6*c* are inserted. It will therefore be understood that in this embodiment the spinnaker 6 can swivel about the cable 30. This structure is advantageous in that the spinnaker 6 can always be retained at positions close to the longitudinal center line of the yacht hull 1. It is therefore possible to prevent the hull from being inclined under the weight of the spinnaker 6 when a swivel movement of the spinnaker 6 is produced.

Figure 15:
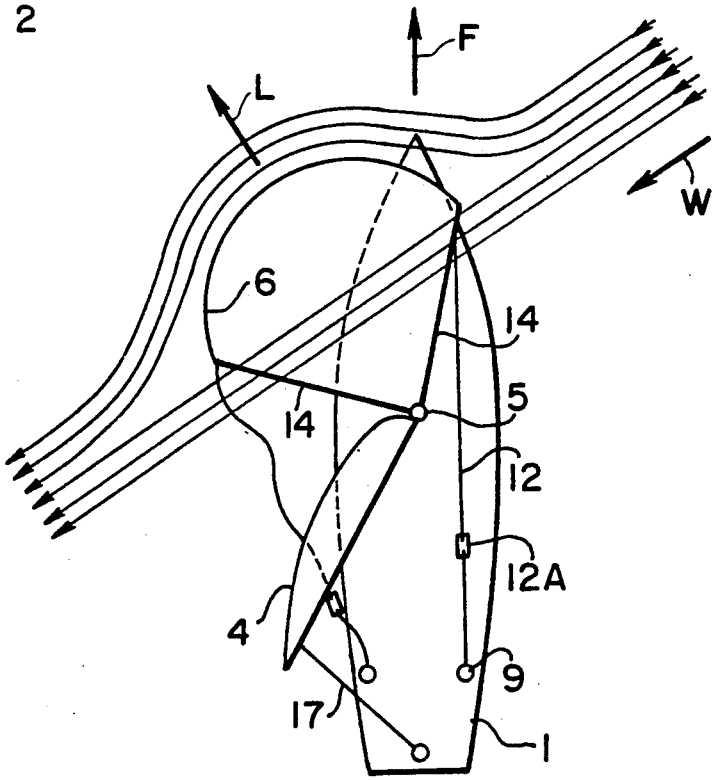
FIG. 15 is a diagrammatical illustration showing an aeronautical force produced in the spinnaker.

FIG. 15 shows one function of the spinnaker 6 in accordance with the present invention. When the spinnaker 6 receives an oblique head wind as shown by an arrow W, aeronautical lift force L will be produced in the spinnaker 6. The lift force L has a component in the front direction F so that the spinnaker 6 can produce a forwardly directed thrust force.

The invention has thus been shown and described with reference to specific embodiments, however, it should be noted that the invention is in no way limited to the details of the specific structures but changes and modifications may be made without departing from the scope of the appended claims.

I claim:

1. A yacht structure including a hull, a mast provided on the hull to extend upward from the hull for supporting a main sail, a spinnaker provided in front of the mast, said spinnaker being retained in bulged configuration to possess an appearance of receiving wind even when it is not receiving wind, said spinnaker having a top portion connected to an upper portion of the mast in a manner which allows a turning movement of the spinnaker about the mast, means engaged with a lower portion of said spinnaker at the opposite sides of said spinnaker for maintaining said spinnaker in positions spaced apart from said mast while at the same time allowing said turning movement of said spinnaker about the mast.

2. A yacht structure in accordance with claim 1 in which said maintaining means includes boom means which extend between said spinnaker and said mast.

3. A yacht structure in accordance with claim 2 in which said lower portion of said spinnaker is further connected with a rear portion of said hull through flexible connecting means.

4. A yacht structure in accordance with claim 1 in which said spinnaker is made of a formed plastic.

5. A yacht structure in accordance with claim 1 in which said spinnaker is made of a flexible sheet material and includes arch shaped rib means for retaining the bulged configuration of the spinnaker.

6. A yacht structure in accordance with claim 1 in which said spinnaker is made of a plastic material and has rib means integrally formed on a rear surface.

7. A yacht structure in accordance with claim 1 in which said spinnaker is made of a plastic material and had corner portions provided with reinforcement plates attached thereto.

8. A yacht structure including a hull, a mast provided on the hull to extend upward from the hull for supporting a main sail, a spinnaker provided in front of the mast, said spinnaker being retained in a bulged configuration to possess an appearance of receiving wind even when it is not receiving wind, said spinnaker having a top portion connected to an upper portion of the mast in a manner which allows a turning movement of the spinnaker about the mast, cable means extending between an upper end portion of said mast and a front end portion of said hull, means connecting said cable means to said spinnaker at points intermediate of the side edges of the spinnaker so that the spinnaker can swivel about said cable means.

9. A yacht model including a hull, a mast provided on the hull to extend upward from the hull for supporting a main sail, a spinnaker provided in front of the mast, said spinnaker being made of a plastic material and formed in a bulged configuration to possess an appearance of receiving wind even when it is not receiving wind, said spinnaker having a top portion connected to an upper portion of the mast in a manner which allows a turning movement of the spinnaker about the mast, said spinnaker having a lower portion which is maintained spaced apart from said mast and is connected at the opposite sides to a rear portion of said hull through connecting means made of a wire.

10. A yacht model in accordance with claim 9 in which said spinnaker is made of a plastic material and has rib means integrally formed on a rear surface.

11. A yacht model in accordance with claim 9 in which said spinnaker is made of a plastic material and had corner portions provided with reinforcement plates attached thereto.

12. A yacht model including a hull, a mast provided on the hull to extend upward from the hull and supporting a main said, a spinnaker provided in front of the mast, said spinnaker being made of a plastic material and formed in bulged configuration to possess an appearance of receiving wind even when it is not receiving wind, said spinnaker having a top portion connected to an upper portion of the mast in a manner which allows a turning movement of the spinnaker about the mast, means for maintaining the opposite sides of a lower portion of said spinnaker in positions spaced from said mast, said opposite sides of said lower portion of said spinnaker being movable with respect to said hull in response to said turning movement of said spinnaker, the lower portion of said spinnaker being connected at the opposite sides to a rear portion of said hull through flexible connected means.

13. A yacht model including a hull, a mast provided on the hull to extend upward from the hull and supporting a main said, a spinnaker provided in front of the mast, said spinnaker being made of a plastic material and formed in bulged configuration to possess an appearance of receiving wind, said spinnaker having a top portion connected to an upper portion of the mast in a manner which allows a turning movement of the spinnaker about the mast, boom means including upper arm means and lower arm means, said boom being connected to said mast through swivel means provided at a plurality of vertically spaced positions and located on opposite sides of said spinnaker at its lower end between said mast and a lower portion of said spinnaker for maintaining said lower portion of said spinnaker in positions spaced from said mast while allowing said turning movement, the lower portion of said spinnaker being connected at the opposite sides to a rear potions of said hull through flexible connecting means, said flexible connecting means further being connected to an intermediate portion of said lower arm means.

* * * * *